US009899772B2

(12) United States Patent
Tiberghien et al.

(10) Patent No.: US 9,899,772 B2
(45) Date of Patent: Feb. 20, 2018

(54) ELECTRIC CONNECTOR

(71) Applicant: STAUBLI FAVERGES, Faverges (FR)

(72) Inventors: Alain-Christophe Tiberghien, Sevrier (FR); Christophe Durieux, Gilly sur Isere (FR); Florian Mille, Faverges (FR)

(73) Assignee: STAUBLI FAVERGES, Faverges (FR)

( * ) Notice: Subject to any disclaimer, the term of this patent is extended or adjusted under 35 U.S.C. 154(b) by 0 days.

(21) Appl. No.: 15/444,474

(22) Filed: Feb. 28, 2017

(65) Prior Publication Data

US 2017/0264049 A1 Sep. 14, 2017

(30) Foreign Application Priority Data

Mar. 11, 2016 (FR) ..... 16 52061

(51) Int. Cl.
*H01R 13/62* (2006.01)
*H01R 13/633* (2006.01)
(Continued)

(52) U.S. Cl.
CPC ..... *H01R 13/633* (2013.01); *H01R 13/625* (2013.01); *H01R 13/631* (2013.01); *H01R 13/639* (2013.01); *H01R 13/641* (2013.01)

(58) Field of Classification Search
CPC .. H01R 13/639; H01R 13/631; H01R 13/633; H01R 13/62; H01R 13/625; H01R 13/52; H01R 13/641
(Continued)

(56) References Cited

U.S. PATENT DOCUMENTS 4,066,315 A * 1/1978 Arneson ..... H01R 13/622 439/311
4,076,361 A * 2/1978 Campbell ..... H01R 13/631 439/352
(Continued)

FOREIGN PATENT DOCUMENTS

DE 196 45 730 5/1997

OTHER PUBLICATIONS

French Search Report for priority application FR 1652061, dated Nov. 11, 2016, 2 pages, showing code "A", Citation of General Interest for all cited references.

*Primary Examiner* — Abdullah Riyami
*Assistant Examiner* — Vladimir Imas
(74) *Attorney, Agent, or Firm* — Dowell & Dowell, PC

(57) ABSTRACT

A first connector (R) element (100) comprises a first body (102) secured to a locking pin (104) and a first indexing member (106). The second connector (R) element (200) comprises a locking ring (216) axially immobilized and rotatable around a second body (202), as well as at least one second indexing member. The second connector element (200) comprises an obstacle (230) moving, relative to the locking ring (216), between a first position blocking the rotation of the locking ring (216), and a second, released position. The second connector element (200) comprises a blocking ring (240) moving, relative to the second body (202), between a forward position, and at least one withdrawn position. The blocking member (230) can block the locking ring (216) in a configuration where the mouth of the slot is aligned with the locking pin. During the fitting, the blocking ring (240) is pushed back by a portion (1044) of the first connector element (100).

15 Claims, 13 Drawing Sheets

(51) Int. Cl.
*H01R 13/631* (2006.01)
*H01R 13/639* (2006.01)
*H01R 13/625* (2006.01)
*H01R 13/641* (2006.01)

(58) Field of Classification Search
USPC ..... 439/299, 639, 311
See application file for complete search history.

(56) References Cited

U.S. PATENT DOCUMENTS 4,277,125 A * 7/1981 Ball ..... H01R 13/622 439/311
RE31,995 E * 10/1985 Ball ..... H01R 13/622 439/313
4,547,032 A 10/1985 Burns et al.
4,744,770 A * 5/1988 Drogo ..... H01R 13/64 439/310
4,784,044 A * 11/1988 Klement ..... B23B 31/261 92/23
6,976,875 B2 * 12/2005 Nishide ..... H01R 13/516 439/598
7,059,916 B2 * 6/2006 Nishide ..... H01R 13/641 439/686
7,081,001 B1 7/2006 Conroy et al.
7,108,551 B2 * 9/2006 Nishide ..... H01R 13/641 439/595
7,682,177 B2 * 3/2010 Berthet ..... H01R 13/622 439/321
7,726,998 B2 * 6/2010 Siebens ..... H01R 11/28 439/299
9,039,436 B2 * 5/2015 Tiberghien ..... H01R 13/625 439/311
9,080,712 B2 * 7/2015 Tiberghien ..... F16L 55/10
9,528,650 B2 * 12/2016 Tiberghien ..... F16L 37/086
2005/0197000 A1 * 9/2005 Tiberghien ..... F16L 37/42 439/369
2008/0252069 A1 * 10/2008 Tiberghien ..... F16L 37/0841 285/81
2014/0174577 A1 * 6/2014 Tiberghien ..... F16L 55/10 137/798
2014/0264118 A1 * 9/2014 Tiberghien ..... F16L 37/086 251/148
2015/0001844 A1 * 1/2015 Tiberghien ..... F16L 37/0841 285/315
2015/0233509 A1 * 8/2015 Tiberghien ..... F16L 37/113 285/119
2015/0338006 A1 * 11/2015 Tiberghien ..... F16L 37/098 285/321

* cited by examiner

ELECTRIC CONNECTOR

The present invention relates to an electric connector comprising a first connector element and a second connector element complementary to the first, these two connector elements being provided to fit in one another. For example, such a connector can be used to electrically connect an electric vehicle to a power source, in order to recharge the batteries of this vehicle.

BACKGROUND OF THE INVENTION

One connector that may be appropriate for this application is known from EP-A-2,752,946. In this connector, during the fitting or coupling of the elements of the connector, their bodies are indexed around a longitudinal axis, in order to align each prong with a corresponding contact. Next, pins are immobilized by engagement in corresponding locking slots, withdrawal of a safety tab, and elastic return of this safety tab to the position blocking the pins in the slots. To allow a pin to penetrate the corresponding locking slot automatically, it is necessary for the locking ring to be oriented relative to the body around which is mounted to align itself with this locking pin. This is possible owing to a largely flared entry bevel of the locking slot, this bevel covering the angular travel range of the locking ring. This connector is globally satisfactory. However, the presence of the bevel increases the axial length of the locking ring, and therefore the axial length of the electric connector thus formed. Yet in some applications, it is necessary to provide an electric connector with a reduced axial bulk.

Comparable problems arise with the equipment known from DE-A-196 45 730 and U.S. Pat. No. 4,547,032, which lacks a locking ring movable between a forward position and a withdrawn position.

BRIEF SUMMARY OF THE INVENTION

The invention more particularly aims to resolve these problems by proposing a new electric connector in which a locking pin can effectively be placed in a locking slot, without having to use an entry bevel.

To that end, the invention relates to an electric connector comprising a first connector element and a second connector element complementary to the first connector element, these two connector elements being provided to fit in one another along a fitting axis. The first connector element comprises a first body that is secured to at least one locking pin and that bears at least one first prong or first contact. The first connector element also comprises at least one first indexing member secured to the first body. The second connector element comprises a second body that supports at least one second contact or second pin complementary to the first prong or first contact, as well as a locking ring mounted around the second body while being axially immobilized, along the fitting axis, and rotatable, around this axis, relative to the second body. This locking ring is provided with at least one locking slot, with a mouth and a locking end provided to receive the locking pin in a configuration where the locking pin is axially locked, along the fitting axis, relative to the second body. The second connector element also comprises at least one second indexing member configured to cooperate with the first indexing member, secured to the second body and configured to position the first body angularly relative to the second body around the fitting axis in an indexed configuration that occurs, during the fitting of the first and second connector elements, before the engagement of the locking pin in the locking slot. According to the invention, the second connector element comprises at least one obstacle moving relative to the locking ring between a first position blocking the rotation of the locking ring relative to the second body and a second, released position in which the obstacle does not oppose a rotation of the locking ring around the second body. Furthermore, the second connector element comprises a blocking ring moving, relative to the second body and along the fitting axis, between a first forward position, and at least one second withdrawn position. The second connector element lastly comprises a member for elastically returning the blocking ring toward its first forward position. The obstacle, the locking ring and the second body are configured so that, when the first and second indexing members cooperate and when the obstacle is in its first blocking position, this obstacle blocks the locking ring relative to the second body in a configuration where the mouth of the locking slot is aligned, in a direction parallel to the fitting axis, with the locking pin. Furthermore, the blocking ring is configured so as, during the fitting of the first and second connector elements and when the first and second indexing members cooperate, on the one hand, to be in its first forward position, in which it keeps the obstacle in its first blocking position, before the locking pin is engaged in the locking slot, and on the other hand, to be pushed by a portion of the first connector element, from its first forward position into its second withdrawn position, in which it does not oppose the passage of the obstacle toward its second released position.

Owing to the invention, the obstacle provided in the second connector element makes it possible to guarantee appropriate positioning of the or each locking slot relative to the corresponding locking pin(s) upon coupling when the indexing members cooperate. More specifically, the invention makes it possible to guarantee that the or each locking pin is aligned, in a direction parallel to the fitting axis, with the entry of the corresponding locking slot, which makes it possible to do away with the use of an entry bevel. The axial length of the locking ring can thus be reduced, as can the overall axial bulk of the connector.

According to advantageous, but optional aspects of the invention, such a connector may incorporate one or more of the following features, considered according to any technically admissible combination:

- The blocking ring is secured in rotation with the locking ring.
- The second body comprises at least one concave cavity and the obstacle is engaged in the concave cavity when it is in its first blocking position.
- The body also comprises a circumferential peripheral groove that communicates with the concave cavity and that is able to receive the obstacle when it is in its second released position.
- The obstacle is movable in a radial orifice of the locking ring and the blocking ring is provided with a first inner radial surface, which, in the uncoupled configuration of the electric connector, surrounds the obstacle and keeps the obstacle in its first blocking position.
- The blocking ring is provided with a second inner radial surface, which is cylindrical with a circular base and the radius of which is strictly larger than the radius of the first inner radial surface, which is also cylindrical with a circular base, while the second inner radial surface defines a housing for partially receiving the obstacle when the blocking ring is in its second withdrawn position.

The blocking ring has multiple parts and comprises a front part intended to be in contact with the portion of the first connector element during the fitting of the first and second connector elements and a rear part that is provided with first and second inner radial surfaces.

The blocking ring comprises a release tab that is aligned with the mouth, in a direction parallel to the fitting axis, which is axially movable in the locking slot and which is configured to be pushed by the portion of the first connector element, which is then formed by the locking pin during the fitting of the first and second connector elements, while moving the blocking ring from its first forward position to its second withdrawn position.

During the fitting of the first and second connector elements, the blocking ring reaches its second withdrawn position when the locking pin is completely engaged in the locking slot.

The connector comprises at least three obstacles, preferably six obstacles, distributed around the fitting axis, and each obstacle is formed by a ball.

The second connector element comprises a safety tab stationary in rotation around the fitting axis, and axially movable along this axis, relative to the locking ring between a first stop position, in which it blocks the passage of the locking pin between the locking end of the locking slot and the mouth of the locking slot, and a second released position, in which it allows the passage of the locking pin. A member for elastically returning the safety tab toward its first stop position is also provided.

The safety tab is different from the release tab.

The safety tab is fast with the blocking ring.

The locking slot comprises a front edge and/or a rear edge inclined relative to the fitting axis and relative to a plane perpendicular to the fitting axis and that extends from the mouth to the locking end.

In the fitted configuration of the connector, the blocking ring at least partially covers the locking slot and the locking pin.

BRIEF DESCRIPTION OF THE SEVERAL VIEWS OF THE DRAWINGS

The invention will be better understood, and other advantages thereof will appear more clearly, in light of the following description of one embodiment of an electric connector and a recharging installation according to its principle, provided solely as a non-limiting example and done in reference to the appended drawings, in which.

DETAILED DESCRIPTION OF THE INVENTION

Figure 1:
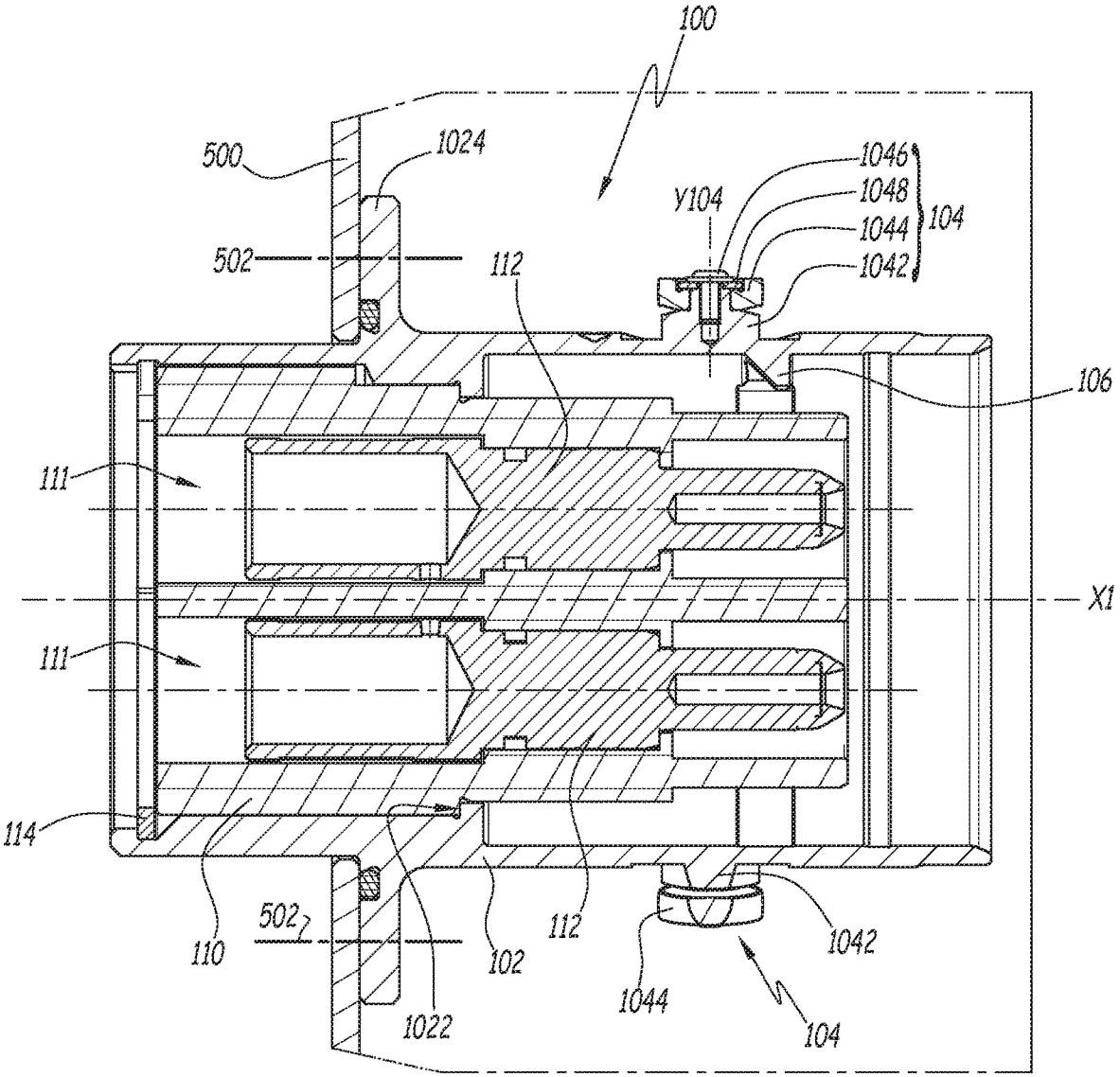
FIG. 1 is an axial sectional view of a first element of an electric connector according to the invention, used within a recharging installation also according to the invention.

In the aforementioned figures, prongs and contacts are visible. They are normally connected to conductive cables that are not shown, for clarity of the drawing.

In the rest of this description, the forward direction of a connector element is defined as the direction oriented in the fitting or coupling direction, i.e., toward the complementary connector element. Conversely, the rear direction of a connector element is defined as the direction opposite the complementary connector element.

Figure 2:
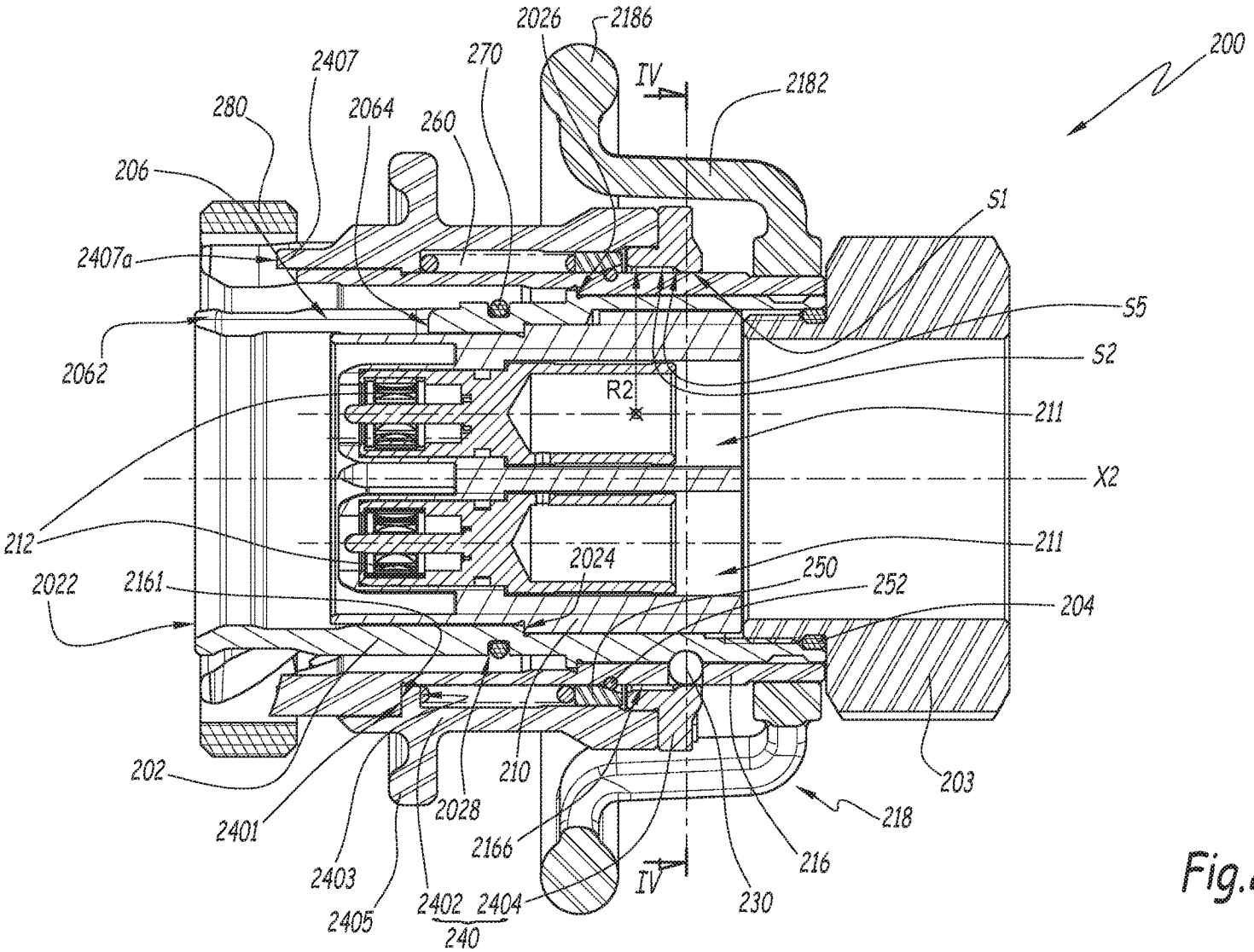
FIG. 2 is an axial sectional view similar to FIG. 1 for a second element of the connector according to the invention.
Figure 3:
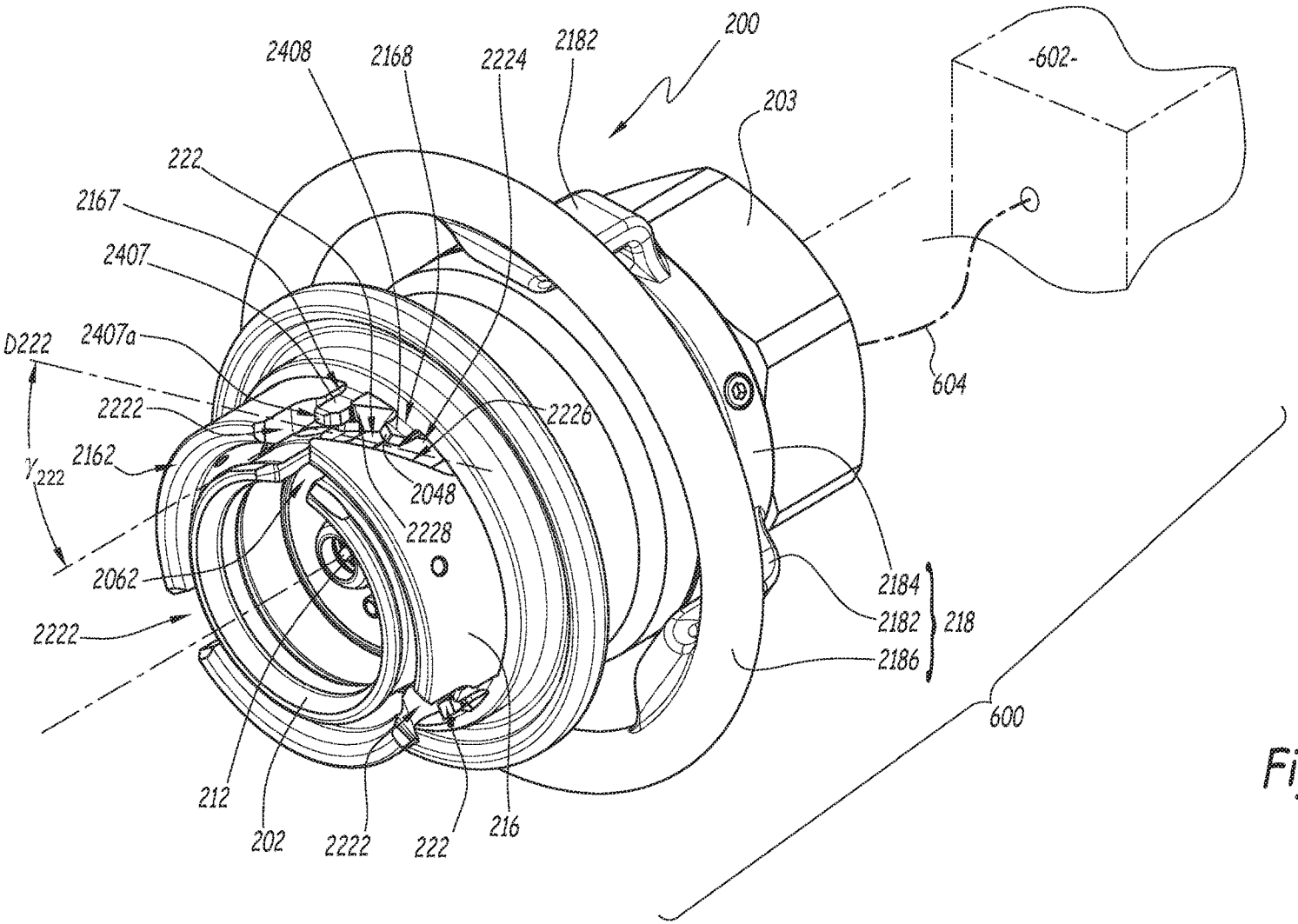
FIG. 3 is a perspective view of the second connector element shown in section in FIG. 2.
Figure 4:
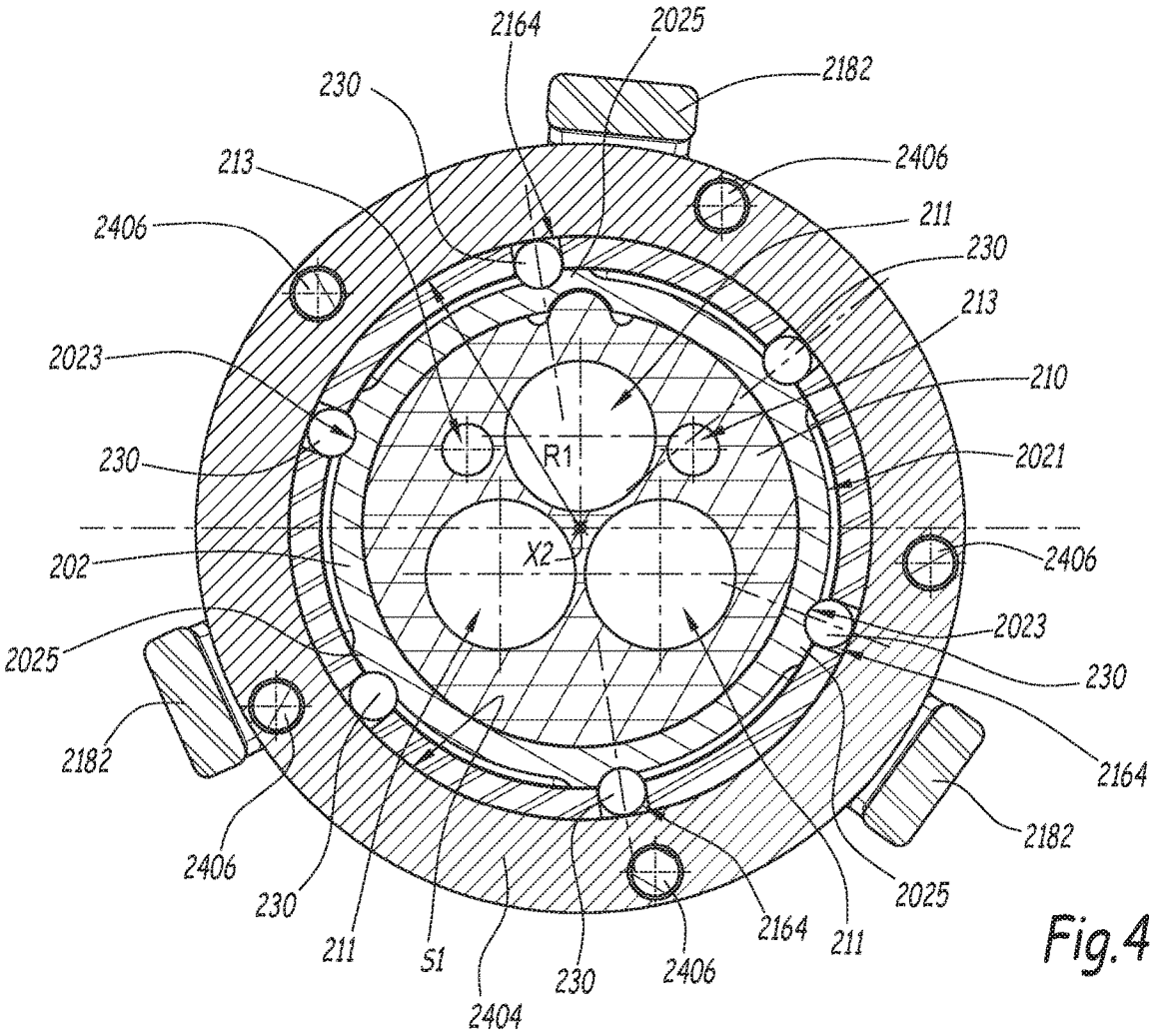
FIG. 4 is a cross-sectional view along line IV-IV in FIG. 2.
Figure 5:
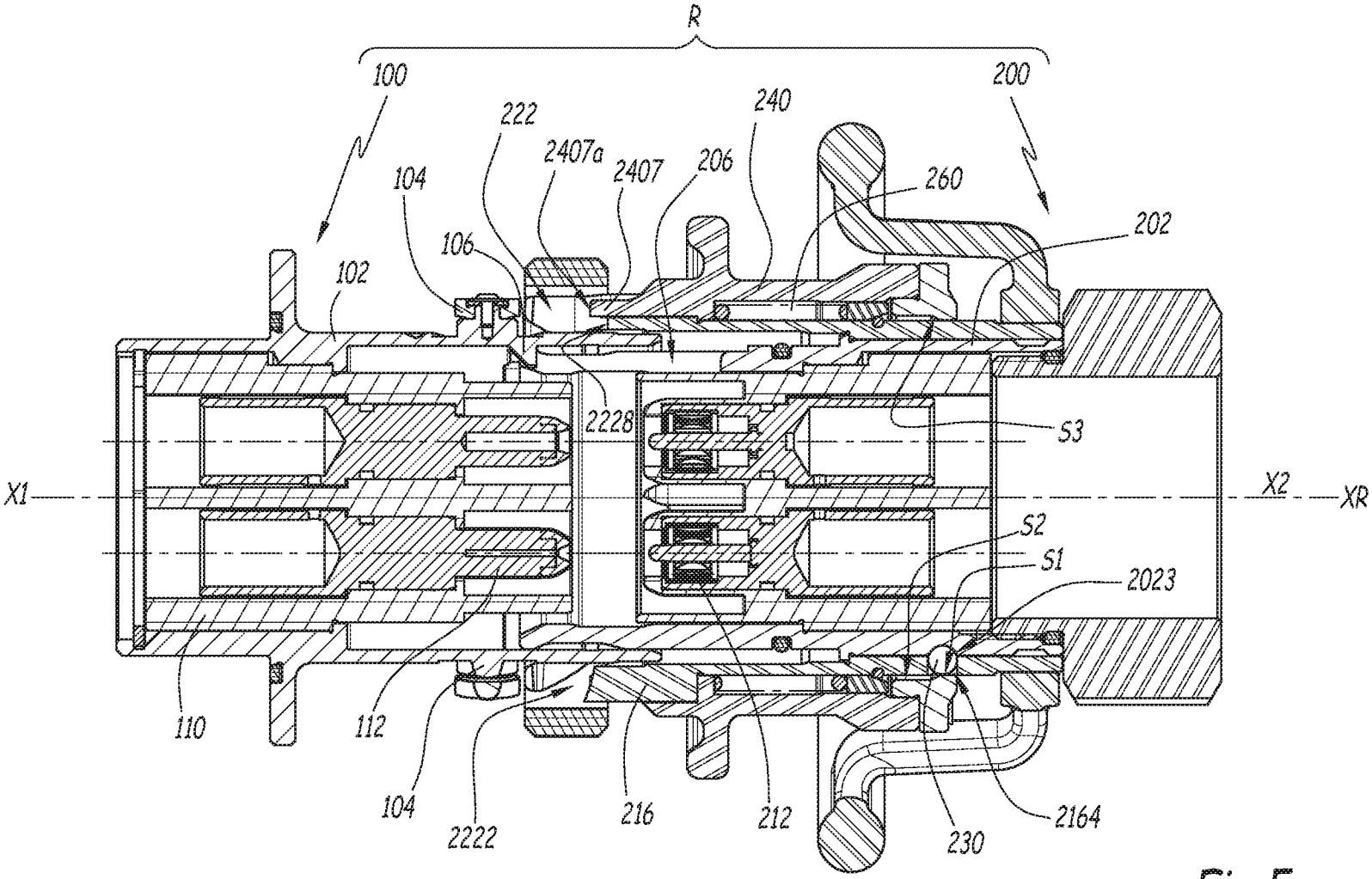
FIG. 5 is a smaller-scale axial sectional view of the male and female elements of the connector during a prior fitting step thereof.

The female element 100 shown in the uncoupled state in FIG. 1 belongs to an electric connector R shown in FIG. 5 and following and that also comprises a male element 200 shown in the uncoupled state in FIGS. 2 to 4.

The female element 100 has a globally cylindrical structure centered on an axis X1. This female element 100 includes an outer body 102 on which three locking pins 104 are fixedly positioned, radially and oriented outward. Each locking pin 104 extends along an axis Y104 radial to the axis X1 and comprises a hub 1042 forming a single piece with the body 102, a roller 1044, a screw 1046 and a washer 1048, the screw and the washer being used to keep the rollers 1044 on the hub 1042, with the possibility of rotation around the axis Y104. The three locking pins 104 are positioned angularly equally distributed around the axis X1, i.e., with an angular interval of 120° around this axis.

In general, at least one locking pin 104 is necessary to lock the connector R.

The body 102 of the female element 100 further includes an indexing tooth 106 positioned radially inside the body 102 and in front relative to the locking pins 104. In other words, the indexing tooth 106 is oriented toward the male element 200 during the fitting or coupling of the elements 100 and 200 of the connector R. Furthermore, the angular orientation of the indexing tooth 106 around the axis X1 is the same as that of one of the locking pins 104.

Inside the outer body 102, an insulating inner body 110 is positioned, with a cylindrical shape and also centered on the axis X1. This body 110 defines two housings 111 in each of which a power prong 112 is positioned. According to aspects of the invention that are not shown, the body 110 can also contain a ground prong and pilot prongs, as considered in the EP-A-2,752,946. The insulating body 110 bears against an inner shoulder 1022 of the outer body 102 and is kept in position inside this body using a circlip 114. The insulating body 110 is made stationary in rotation around the axis X1 in the outer body 102 by cooperation of an axial rib of the insulating body 110 with an axial slot of the outer body 102.

Figure 9:
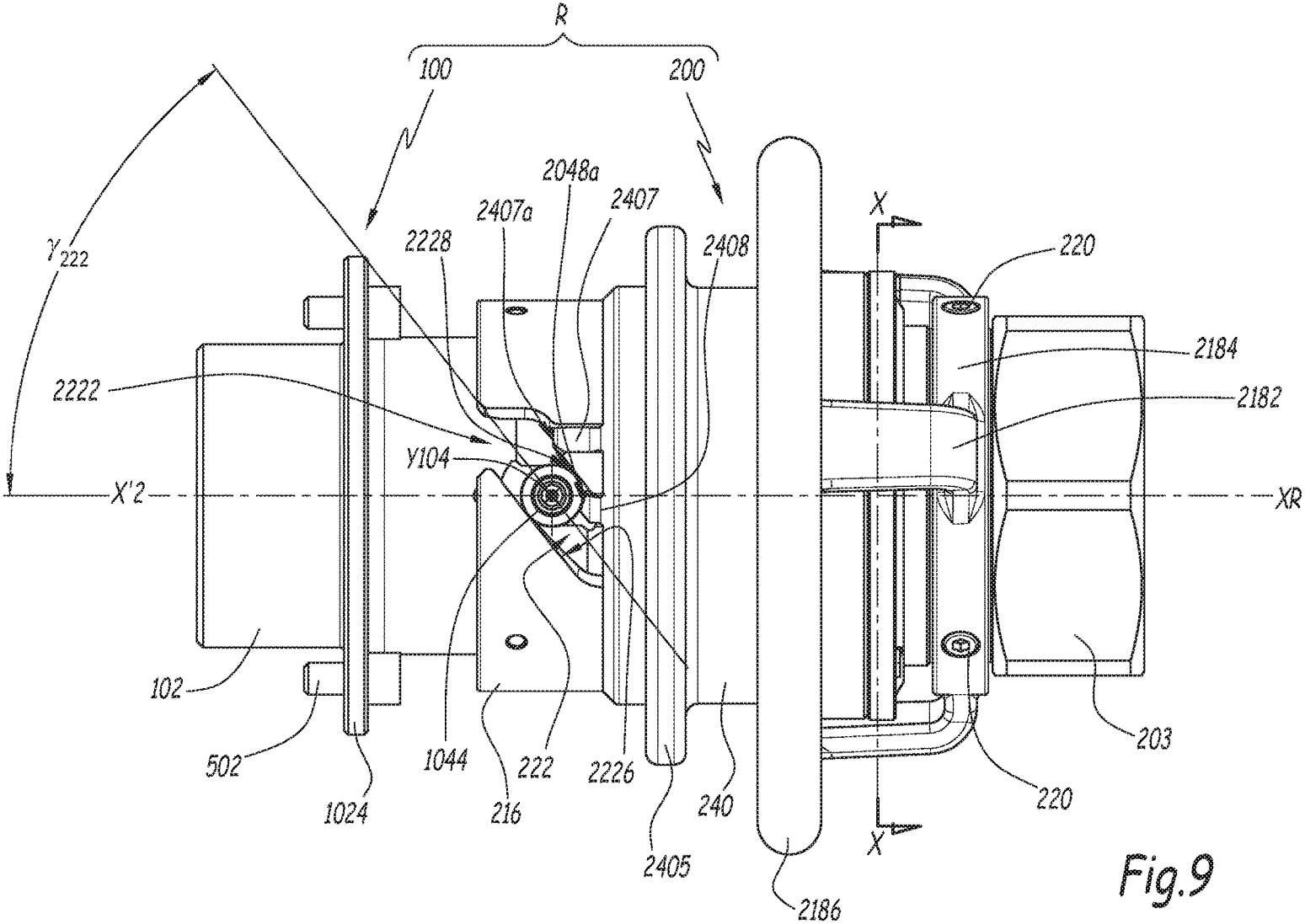
FIG. 9 is an outside view of the male and female elements of the connector during a second fitting step.
Figure 12:
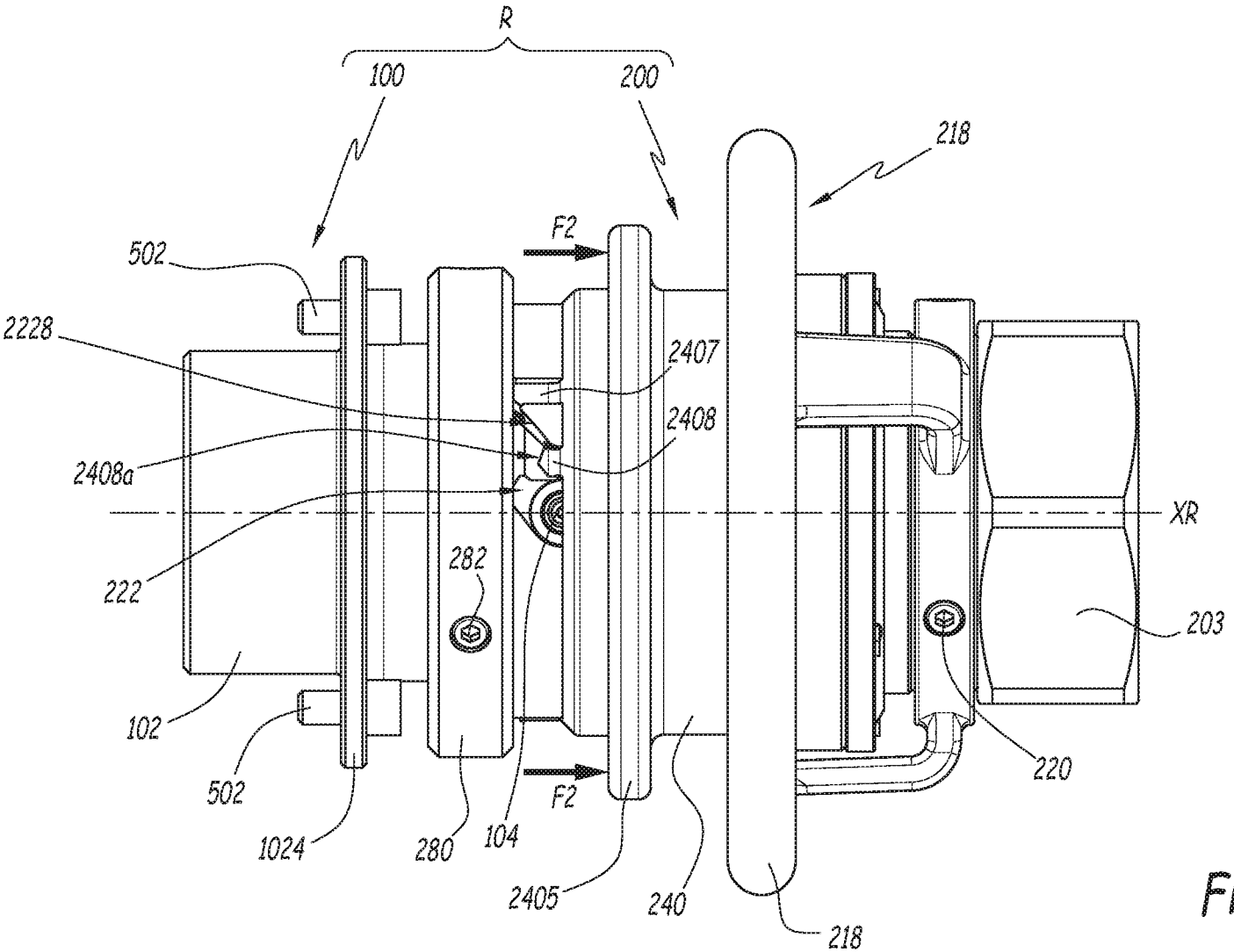
FIG. 12 is an outside view of the connector in the fitted configuration.

The female connector element 100 is mounted on a body element 500 of a motor vehicle using screws 502 that traverse an outer peripheral collar 1024 of the body 102, as well as the body 500. In FIG. 1, the screws 502 are shown by their axis lines. In FIGS. 9 and 12, the body 500 is omitted for clarity of the drawing.

The male element 200, which is shown in the uncoupled state in FIGS. 2 to 4, also belongs to the connector R. It is integrated into a recharging station 600 and connected to a stationary unit 602 of this station by a flexible cable 604. The parts 600, 602 and 604 are shown in mixed lines only in FIG. 3. The male element 200 also has a globally cylindrical structure centered on an axis X2. The body 202 of the male element includes an indexing slot 206 that extends parallel to the axis X2 from the front end 2022 of the body 202 where the mouth 2062 of the indexing slot 206 is defined.

As in the female element 100, an inner insulating body 210 is positioned inside the body 202 of the male element 200 and encompasses two power contacts 212 that are complementary to the prongs 112 and each positioned in a housing 211 of the insulating body 210. The insulating body 210 is kept bearing against an inner shoulder 2024 of the body 202 by a rear ring 203 that is screwed on the rear of the body 202, with interposition of a sealing point 204 and that tightly receives the flexible cable 604. The insulating body 210 is made stationary in rotation around the axis X2 in the outer body 202 by cooperation of an axial rib of the insulating body 210 with an axial slot of the body 202.

A locking ring 216 is mounted rotatably around the body 202. The locking ring 216 is immobilized in translation, along the axis X2, relative to the body 202. Indeed, the locking ring 216 is axially jammed between an outer shoulder 2026 of the body 202 and the rear ring 203. A flywheel 218 is secured in rotation and translation with the ring 216. This flywheel comprises three branches 2182 that connect an inner and rear ring 2184 to an outer and front ring 2186. The flywheel 218 is immobilized on the locking ring 216 using screws 220.

The locking ring 216 includes three locking slots 222 regularly distributed, at 120° intervals, around the axis X2 and that each extend between a mouth 2222 cut in the front edge 2162 of the locking ring 216 and a rear end 2224 that forms a locking zone of a pin 104. The front edge 2162 of the locking ring 216 is positioned behind the front edge 2022 of the body 202. Between the mouth 2222 and the rear end 2224, each slot 222 is defined between a front edge 2226 and a rear edge 2228, these edges being inclined relative to the axis X2 and relative to a plane perpendicular to the axis X2. In particular, the front 2226 and rear 2228 edges are substantially parallel. More specifically, an axis X'2 is considered parallel to the axis X2 and passing through the center of the mouth 2222. A line D222 is also considered parallel to the front edge 2226 or the rear edge 2228 of the slot 222 in a plane orthoradial to the axis X2 passing through the axis X'2. In this orthoradial plane, the axis X'2 and the line D222 define an angle γ222 between them, taken on the front of the connector element 200, that is non-zero and strictly less than 90°. In practice, the angle γ222 is between 30° and 60°, preferably about 45°. It will be noted that the front edge 2226 of the slot 222 is continuous, from the rear end 2224 up to the mouth 2222. The rear edge 2228 is in turn interrupted to allow two tabs to pass, i.e., a release tab 2407 and a safety tab 2408, the functions of which are explained below.

As more particularly shown by FIG. 4, the insulating body 210 defines three housings 211 for power contacts 212 or a ground contact, as well as two housings 213 for pilot contacts not shown in the figures.

The male connector element 200 comprises six balls 230, each housed in a through radial orifice 2164 of the locking ring 216. The diameter of each ball 230 is larger than the radial thickness of the locking ring 216, such that, when they are engaged in the orifices 2164, the balls 230 protrude radially from the ring 216, either inward toward the axis X2 or outward away from this axis. The number of balls 230 may be different from six, while being greater than or equal to one. When several balls are used, they are preferably distributed regularly around the axis X2 owing to appropriate positioning of the orifices 2164.

The body 202 is provided with six identical grooves 2021 that each extend circumferentially over the outer surface of the body 202 and that each end with a cavity or depression 2023, in the form of a concave spherical cap. Each cavity 2023 is hollowed out more deeply, in a radial direction, in the body 202 than the grooves 2021. Each cavity 2023 communicates with a groove 2021. The surface of each cavity 2023 is complementary to the inner radial part of an obstacle 230. In the configuration of FIGS. 2 to 4, each ball 230 is engaged in a cavity 2023. In this configuration, due to the engagement and maintenance of the balls 230 in the cavities 2023, the balls 230 secure the locking ring 216 and the body 202 together in rotation, around the axis X2.

It will be noted that, opposite each cavity 2023, each groove 2021 is bordered by a boss 2025 that separates it from the cavity 2023 making up the end of the adjacent groove 2021.

The male connector element 200 also comprises a blocking ring 240 that comprises a front part 2402 and a rear part 2404. These parts 2402 and 2404 are assembled using five screws 2406, as shown in FIG. 4, only one of these screws being shown in FIG. 7 in light of the cutting planes used. The blocking ring 240 radially surrounds the locking ring 216, as well as the six balls 230. The locking ring 240 is axially movable, along the axis X2, relative to the locking ring 216 and the body 202. More specifically, a bearing ring 250 is mounted around the locking ring 216, this bearing ring being equipped with an inner bevel that rests against an O-ring 252 partially received in an outer peripheral groove of the locking ring 216. A helical spring 260 is axially inserted between the bearing ring 250 and an inner shoulder 2403 of the front part 2402. This spring 260 constitutes an element for elastically returning the blocking ring 240 toward the front of the male element 200. Thus, the bearing ring 250 is kept blocked in translation parallel to the axis X2, in a front-rear direction.

The rear part 2404 of the blocking ring 240 defines a first cylindrical inner radial surface S1 with a circular base and centered on the axis X2, the radius R1 of which is substantially equal to the outer radius of the locking ring 216 measured at an outer radial surface 2166.

The rear part 2404 of the blocking ring 240 also defines a second inner radial surface S2, which is cylindrical with a circular base like the surface S1, but the radius R2 of which is strictly larger than the radius R1 and which is offset forward along the axis X2 relative to the surface S1. The inner radial surfaces S1 and S2 are connected by an inner frustoconical surface S3. In practice, the difference between the radii R1 and R2 is greater than or equal to the depth of the cavities 2023 relative to the grooves 2021. The stepped structure formed by the inner radial surfaces S1 and S2 of the blocking ring 240 allows two separate radial positions of the balls 230, relative to the locking ring 216, within the orifices 2164, namely:

- a first blocking position, in which the surface S1 is axially across from the balls 230, such that it forces these balls to penetrate the cavities 2023, which secures the locking ring 216 and the body 202 in rotation, a second released position, in which the balls 230 can be partially engaged in a volume V1 defined between the surface S2 and the outer radial surface of the locking ring 216, to the point that they can be removed from the cavities 2023 while allowing a relative rotation between the locking ring 216 and the body 202.

The balls 230 therefore constitute an obstacle that makes it possible to block the rotation of the locking ring 216 relative to the body 202, when necessary, as explained below. The grooves 2021 and the cavities 2023 together constitute housings in which the inner radial parts of the balls 230 are engaged, these inner radial parts having, relative to the body 202 and within these housings, a radial movement at the cavities 2023 and a circumferential movement at the grooves 2021.

The blocking ring 240 also comprises three release tabs 2407 that each extend through a longitudinal housing 2167 arranged in the locking ring 216 and that each emerge in a locking slot 222. The blocking ring 240 also comprises three safety tabs 2408 each engaged in a longitudinal housing 2168 of the locking ring 216 and that also each emerge in a locking slot 222. As mentioned above, the release 2407 and safety 2408 tabs interrupt the rear edge 2228 of the slot 222 in which they are engaged.

Since the housings 2167 and 2168 are longitudinal, i.e., parallel to the axis X2, and in light of the respective dimensions of the tabs 2407 and 2408 and these housings, the blocking ring 240 is secured in rotation, around the axis X2, with the locking ring 216.

An O-ring seal 270 is mounted in an outer peripheral groove 2028 of the body 202, this groove being positioned, along the axis X2, past the bottom 2064 of the indexing slot 206 relative to the front end 2022 of the body 202.

The male connector element 200 also comprises a protection ring 280 that is positioned around the front part of the body 202 and that protects the respective mouths 2062 and 2222 of the indexing slot 206 and the locking slots 222 from becoming dirty. To make it possible to view certain parts of the connector R, this protection ring 280 is not shown in FIGS. 3 and 9. As shown in FIG. 12, the protection ring 280 is secured to the locking ring 216 using screws 282, only one of which is visible in this figure.

The blocking ring 240 is provided with an outer peripheral collar 2405.

The connector R works as follows:

In the uncoupled configuration, the female 100 and male 200 elements of the connector are in the configuration of FIGS. 1 to 4. In this configuration, the spring 260 pushes the blocking ring 240 toward the front of the connector element 200, to the point that the tabs 2407 and 2408 protrude in the locking slots 222. In this configuration, the surface S1 of the blocking ring 240 is axially aligned with the balls 240, which are radially maintained by this surface S1 in a configuration engaged within the cavities 2023. An inner front edge 2401 of the blocking ring 240 abuts at the front against an outer shoulder 2161 of the locking ring 216. The position of the cavities 2023 on the outer peripheral surface of the body 202, on the one hand, as well as the position of the orifices 2164 in the locking ring 216, on the other hand, are chosen such that in this configuration, the mouth 2222 of one of the locking slots 222 is angularly aligned, around the axis X2, with the mouth 2062 of the indexing slot 206.

When the elements 100 and 200 of the connector need to be fitted or coupled, their respective central axes X1 and X2 are aligned on a shared fitting axis XR, which is the central axis of the connector R. Next, the indexing members formed by the indexing tooth 106 and the indexing slot 206 are actuated by aligning these members with one another in a direction parallel to the axis XR and engaging the indexing tooth 106 in the indexing slot 206. The cooperation of the indexing members 106, 206 aligns, along the axis XR, each prong 112 supported by the first body 104 with the corresponding contact 212 supported by the second body 204. The bodies 102 and 202 are then in the indexed configuration.

Since the indexing tooth 106 is angularly aligned with one of the pins 104, while the mouth 2222 of one of the locking slots 222 is angularly aligned with the mouth 2062 of the indexing slot 206 by the blocking of the rotation of the blocking ring 216 by the balls 230, this pin 104 is automatically aligned with this mouth 2062 along the axis X'2, without it being necessary to use a centering bevel. In particular, the axis X'2 is secant with the axis Y104 of the pin 104.

Figure 6:
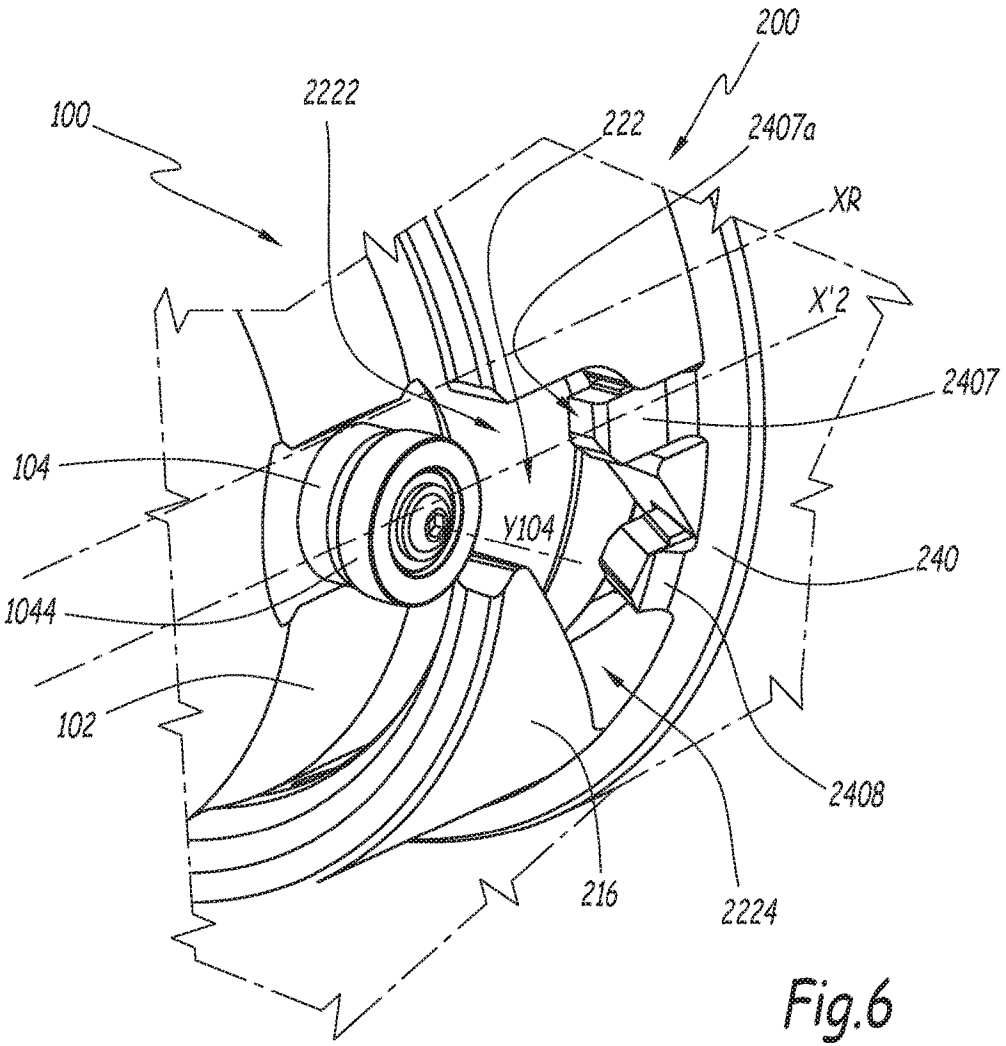
FIG. 6 is a partial perspective view of the male and female elements of the connector in the configuration of FIG. 5.

In other words, in the prior configuration of FIGS. 5 and 6, i.e., at the beginning of fitting of the two connector elements 100 and 200 in one another and before the engagement of the pin 104 in the mouth 2062 of the locking slot 222, the indexing tooth 106 engages in the longitudinal indexing slot 206 and automatically orients the body 102 of the female element 100 relative to the body 202 of the male element 200 around the central axis XR, such that the aforementioned pin 104 is automatically aligned with the mouth 2222 of the aforementioned slot 222. Furthermore, since the three pins 104 and the three slots 222 are regularly distributed around the axis XR, all of the pins 104 and all of the mouths 2222 of the slots 222 are automatically correctly aligned parallel to the axis XR, relative to one another.

Figure 7:
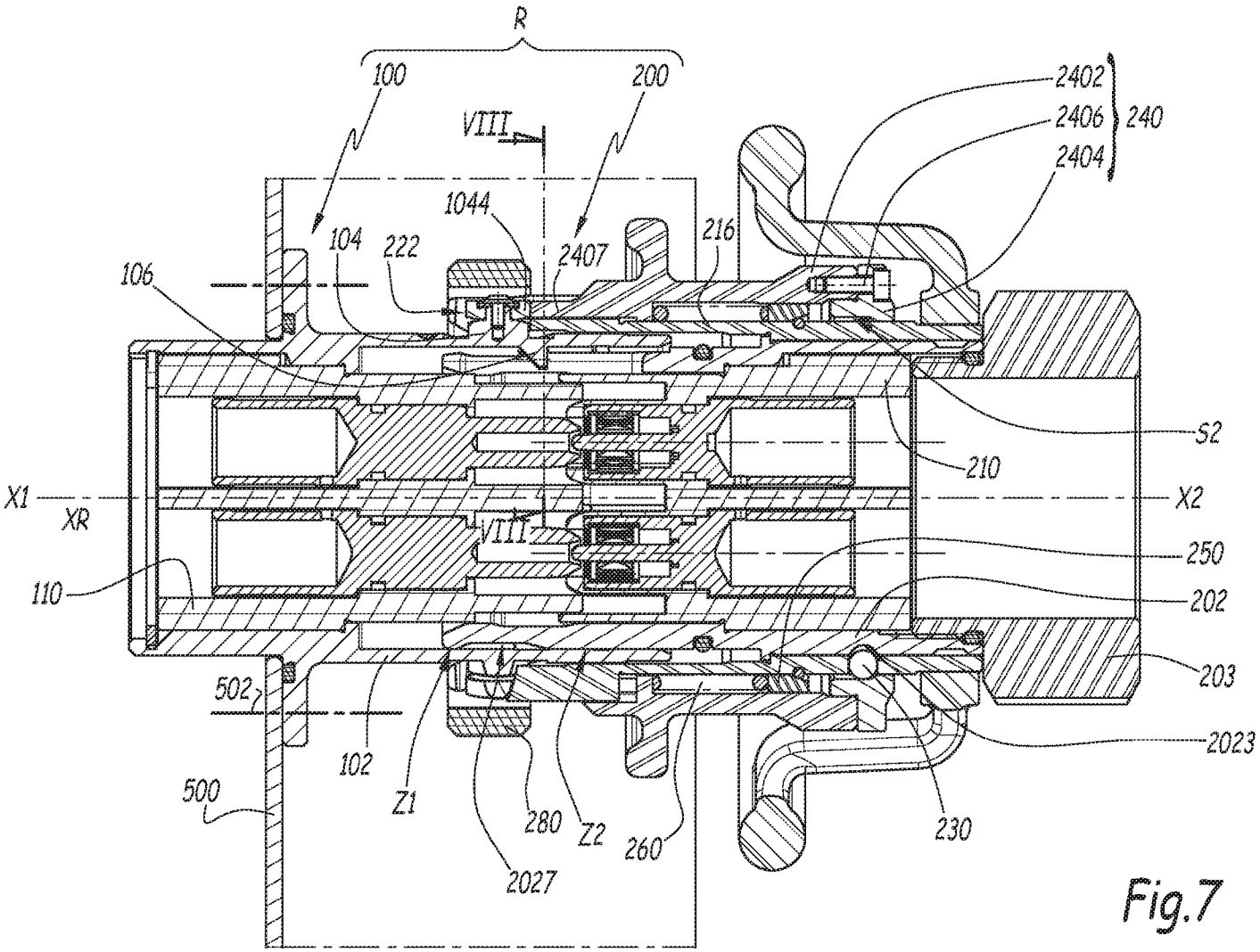
FIG. 7 is an axial sectional view similar to FIG. 5, when the male and female elements of the connector are in a first fitting step.
Figure 8:
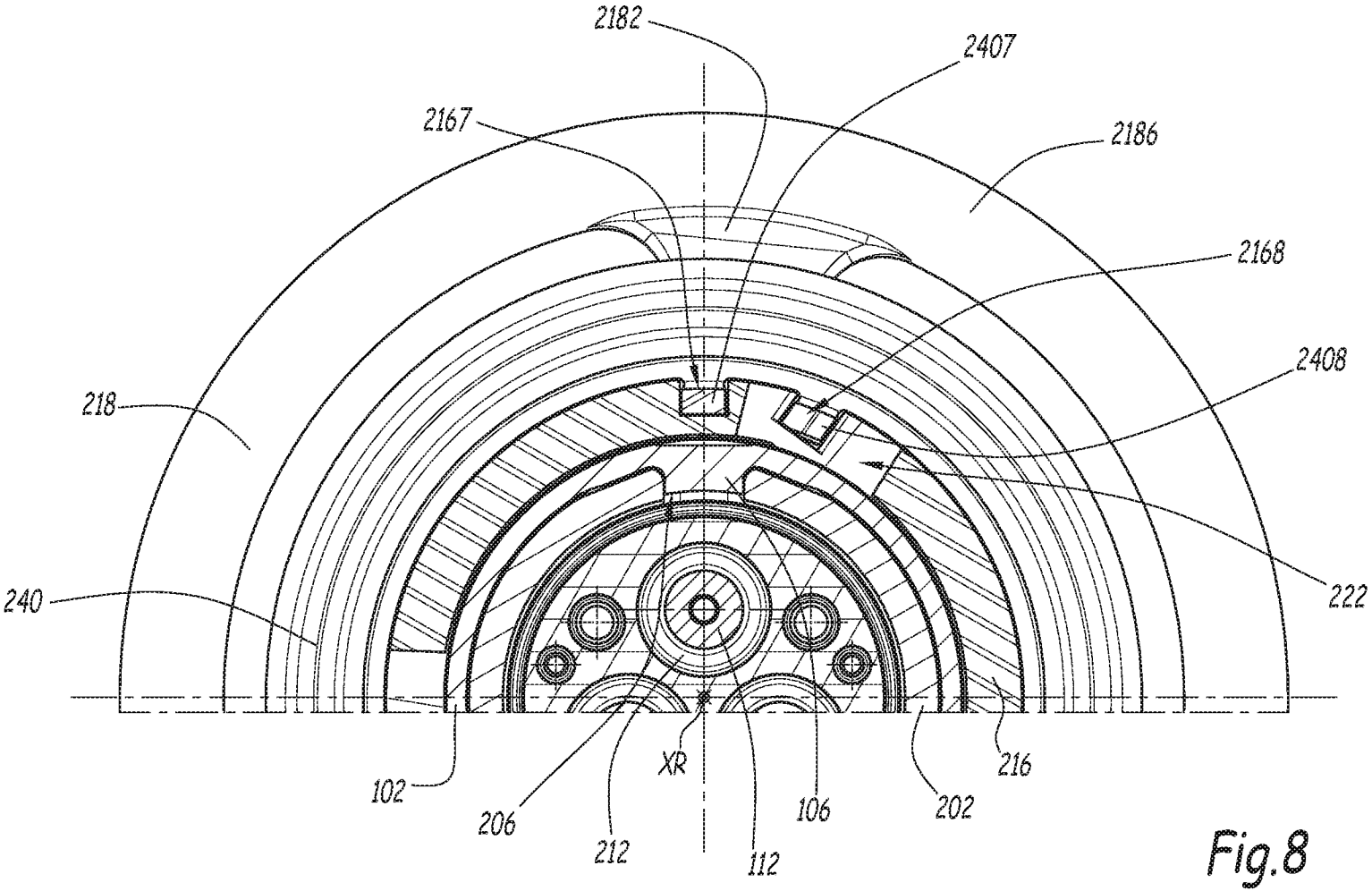
FIG. 8 is a larger-scale half-sectional view along line VIII-VIII in FIG. 5.

The actual fitting of the elements 100 and 200 begins during a first fitting step shown in FIGS. 7 and 8. As shown in FIG. 7, the inner radial surface of the body 102 then bears on two zones Z1 and Z2 of the outer peripheral surface of the body 202 that are axially offset, along the axis XR, from one another, while being positioned on either side of an outer peripheral groove 2027 of the body 202.

From the prior configuration where each pin 104 is aligned on the mouth 2222 of a locking slot 222 and situated outside this slot, the axial movement of the first fitting step of the elements 100 and 200 results in bringing the roller 1044 of each pin 104 into each locking slot 222, then bearing against the release tab 2407 protruding in the corresponding locking slot 222.

This bearing of the rollers 1044 on the release tabs 2407 and the continued fitting of the elements 100 and 200 result in causing the ring 240 to withdraw against the elastic force exerted by the spring 260, which axially offsets the surface S1 relative to the balls 230, which are then radially across from the surface S2. The balls 230 can then move relative to the body 202 from their blocking position to their released position and be partially engaged in the volume V1, which is made up of a radial interstice defined between the surface S2 and the outer radial surface 2166 of the ring 216. In so doing, the balls 230 can be radially removed from the cavities 2023 to each roll in a groove 2021. Thus, during fitting, in the configuration of FIGS. 7 and 8, the balls 230 have reached a released position in which they do not oppose a rotation of the locking ring 216 around the body 202 for the progression of the pin 104 in the locking slot 222 toward the locking end 2224 and the locking of the locking pin 104 in the locking slot 222, since they can roll in the grooves 2021.

The passage from the uncoupled configuration to the configuration of FIGS. 7 and 8 corresponds to a first withdrawal of the blocking ring 240 to an intermediate position where the balls 230 are engaged in the volume V1 near the surface S1. In this configuration of FIGS. 7 and 8, the locking ring 216 has not begun to rotate relative to the body 202. The indexing tooth 106 continues its progression in the indexing slot 206.

As shown in FIGS. 3, 5 and 9, the front surface 2407*a* of the release tab 2407, i.e., the surface that receives the roller 1044 of a pin 104 by bearing, is an axial surface perpendicular to the axis XR, and the axis X'2 is secant with the surface 2407*a* such that upon coupling, in the configuration of FIGS. 7 and 8, the bearing between a pin 104 and the release tab 2407 is only axial. Furthermore, the surface 2407*a* is aligned along the axis X'2 with the mouth 2222, such that the pin 104 inserted into the mouth 2222 in axial motion comes into contact with the surface 2407*a*.

Figure 10:
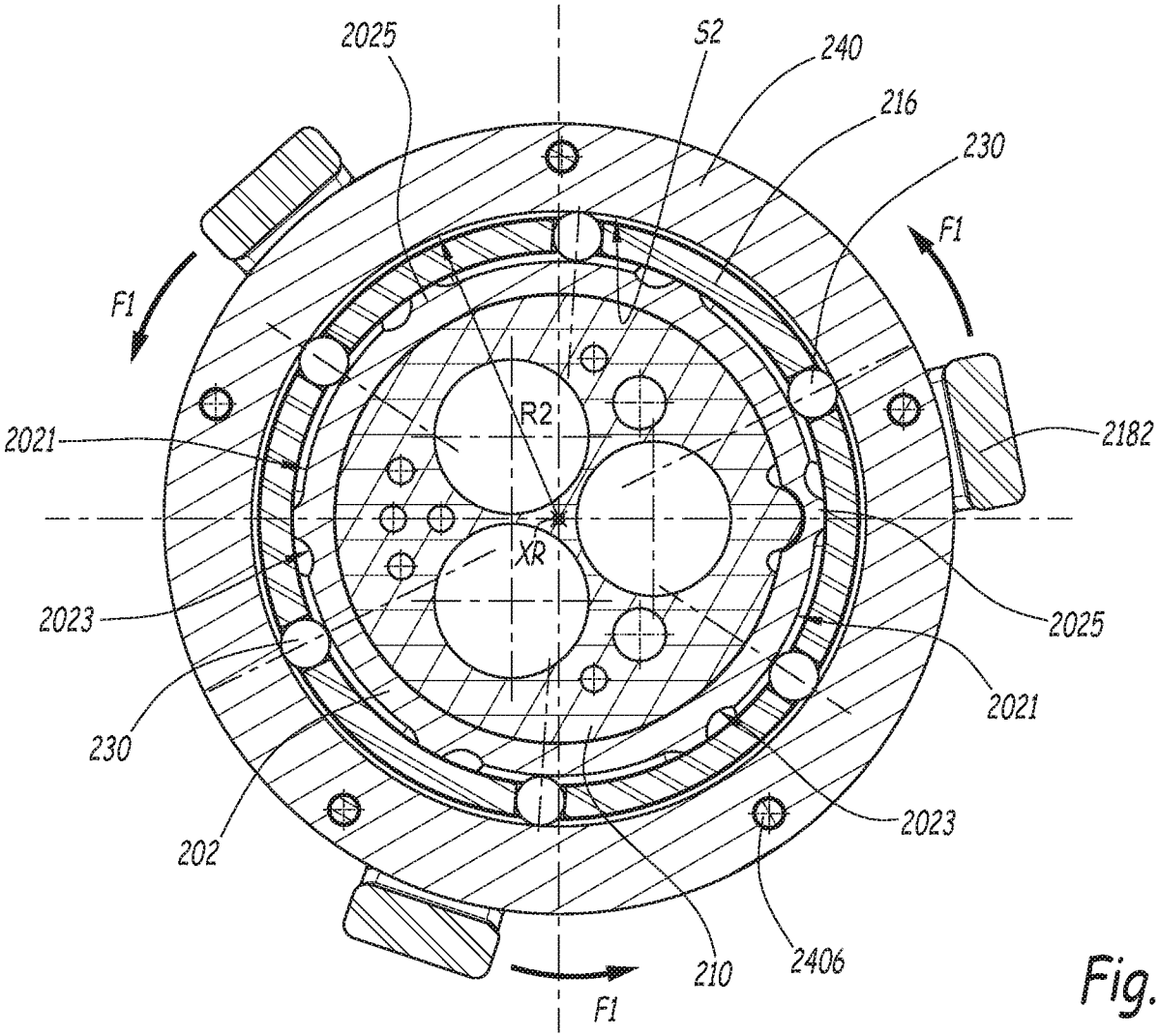
FIG. 10 is a larger-scale sectional view along line X-X in FIG. 7.
Figure 11:
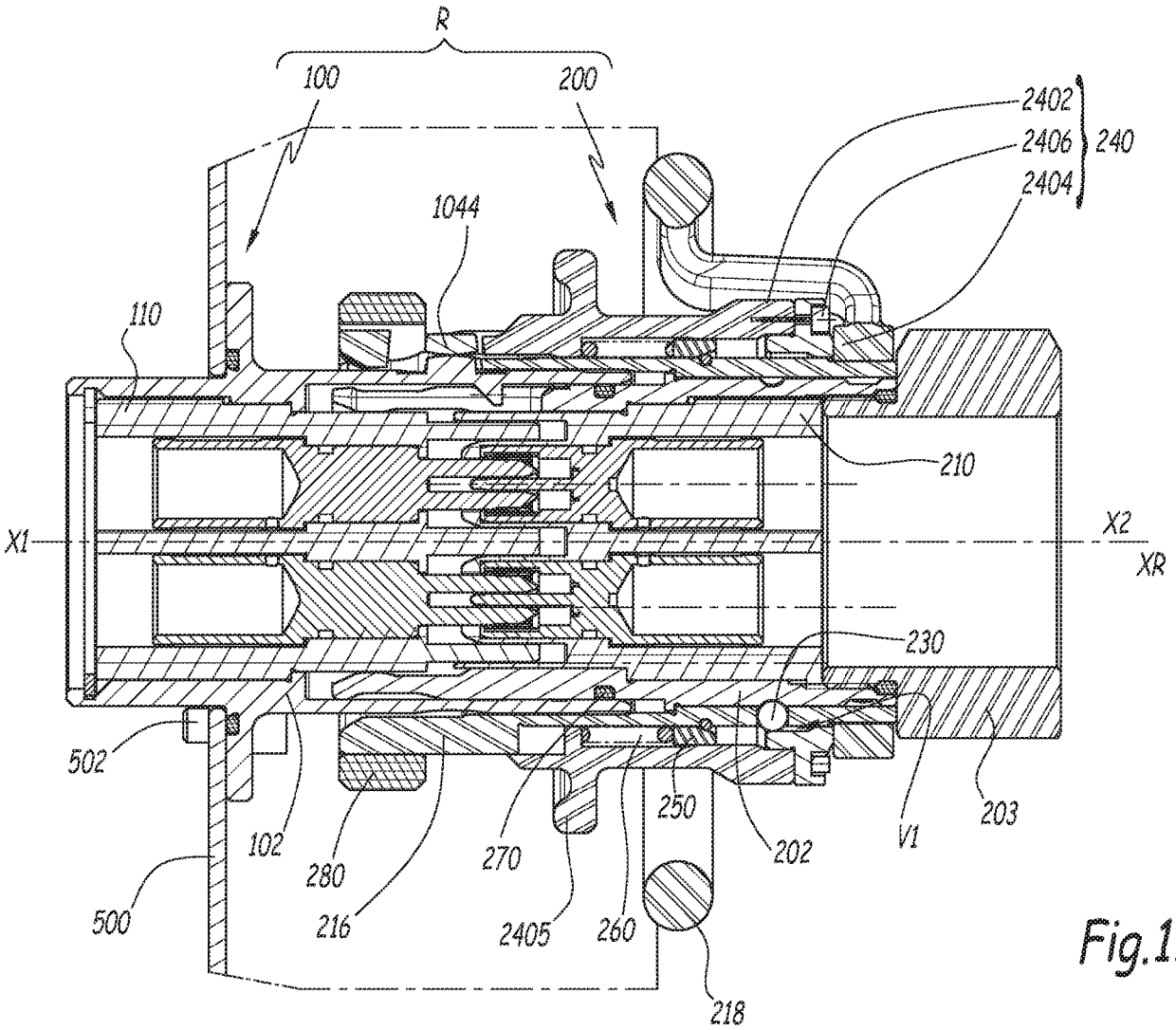
FIG. 11 is a sectional view similar to FIG. 5 during a third fitting step.

By continuing the fitting of the male and female elements in one another, one reaches the configuration of FIGS. 9 to 11. In this configuration, the balls 230 are in the released position in the orifices 2164 and are moved in the grooves 2021 while accompanying the rotational movement of the locking ring 216 around the body 202. In practice, during this step, the locking ring 216 is rotated around the body 202 owing to a torque exerted by the operator on the flywheel 218, in the direction of arrows F1 in FIG. 10. This rotational movement of the locking ring 216 makes it possible to accompany the progression of the locking pins 104 inside the locking slots 222 toward their respective rear ends 2224. It should be noted that once the locking pins 104 leave contact with the release tab 2407, the blocking ring 240 is kept in the intermediate withdrawn position by abutment, under the effect of the spring 260, of the inner frustoconical surface S3 of the blocking ring 240 on the balls 230, which in turn are engaged in the grooves 2021, offset in the circumferential direction relative to the cavities 2023. During this movement, the rollers 1044 of the pins 104 come into contact with the safety tabs 2408, which protrude in the locking slots 2222 and partially obstruct the passage for the pins 104. As shown in FIGS. 3 and 9, each safety tab 2408 is beveled and includes a bowed surface 2408*a* that facilitates a clean bearing of the roller 1044 on the safety tab 2408. Thus, under the effect of the rotation of the locking ring 216 resulting from the torque exerted by the operator on the flywheel 218, each pin 104 pushes the adjacent safety tab 2408 toward the rear of the male connector element 200, which causes a second withdrawal of the blocking ring 240 and frees the passage for this pin, which can reach its locked position at the rear end 2224 of the slot 222, this end being closed.

As shown in FIG. 11, from this configuration and for the rest of the fitting, the body 102 covers the sealing gasket 270, which provides sealing of the connection inside the bodies 102 and 202 when the prongs 112 come into electrical contact with the contacts 212. This FIG. 11 shows that, in light of the second withdrawal of the blocking ring 240, the outer radial parts of the balls 230 are moved within the volume V1 to reach the front end of the rear part 2404. The indexing tooth 106 continues its progression in the indexing slot 206.

Figure 13:
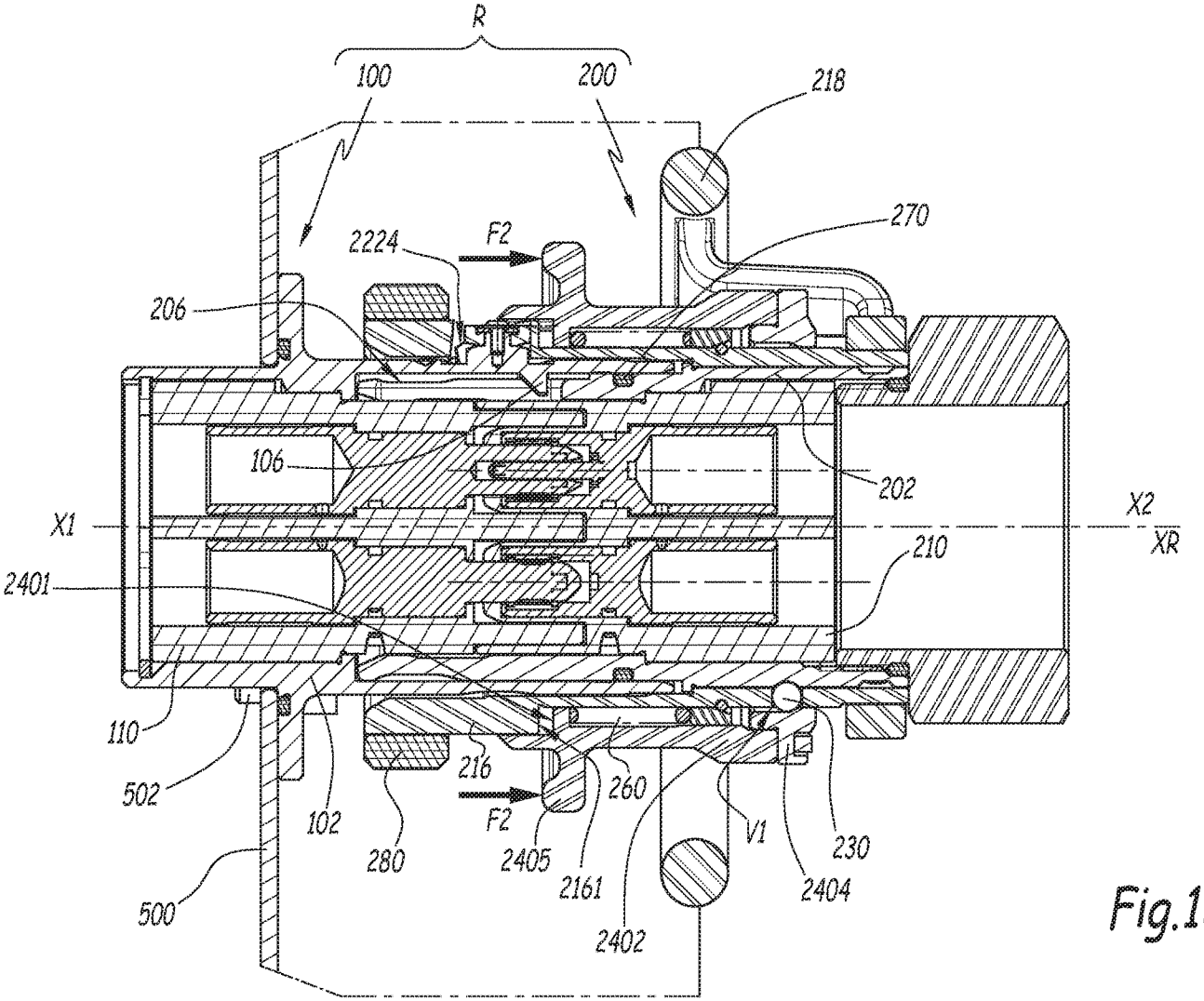
FIG. 13 is an axial sectional view similar to FIGS. 5, 7 and 9 in the fitted configuration.

In the completely fitted or coupled configuration shown in FIGS. 12 and 13, each pin 104 has protruded past the safety tab 2408 that extends in the relevant locking slot 222, such that the spring 260 can send the blocking ring 240 forward again, in a configuration where the latter surrounds and partially covers the locking pins 104 and the locking slots 222, as well as the interstice between the locking ring and the blocking ring, between the shoulder 2161 and the inner front edge 2401, which limits the introduction of dirt into these slots and makes it possible to keep as clean as possible an interstice between the locking ring and the blocking ring.

Upon comparing FIGS. 7, 11 and 13, it will be understood that the blocking ring first withdraws to an intermediate position shown in FIG. 7, then to a maximum rear position shown in FIG. 11, before returning to the intermediate position shown in FIG. 13. In all of these withdrawn positions of the blocking ring 240, the balls 230 are engaged in the volume V1 and can roll in the grooves 2021, such that they do not oppose the rotation of the locking ring 216 relative to the body 202, in the angular travel offered by the circumferential expanse of the groove 2021 and necessary to lock each pin 104 in its locking slot 222.

When each pin 104 reaches the rear end 2024 of the slot 222 in which it is engaged, it is locked in this end by the safety tab 2408, which is returned to the slot because the blocking ring 240 is pushed elastically forward by the spring 260 axially bearing against the balls 230. Thus, the safety tab 2408 axially locks the adjacent pin 104 relative to the male body 202. The safety tab 2408 also blocks the rotation between the locking ring 216 and the pin 104. The indexing tooth 106 is still cooperating with the indexing slot 206. During the fitting, and using an approach consistent with that considered in EP-A-2,752,946, the pilot prongs electrically connect with their respective contacts after the electrical connection of the power circuits, by engagement of the power prongs in their power contact, has been done. This makes it possible to ensure that when the relays are activated upon closing by the pilot circuit, the current can effectively pass through the connector R to recharge the vehicle on the body 500 of which the female connector element 100 is mounted. The electrical connections occur between the configuration of FIGS. 7 and 8 and the configuration of FIG. 11. In the coupled or fitted configuration, each of the prongs of the element 100 is electrically connected with its corresponding contact on the element 200.

In the uncoupled configuration of FIGS. 2 to 4, the protection ring 280 is positioned around the front end of the locking ring 216. It, together with the flywheel 218, which has a substantially larger diameter than that of the body 202, ensures that the sensitive elements of the male connector element 200, such as its locking slots 222 and blocking ring 240, do not come into direct contact with the ground when the male connector element 200 is grounded, which prevents these sensitive elements from being damaged. Indeed, the protection ring 280 and the flywheel 218 constitute protective members that radially surround the sensitive elements of the male element of the connector.

When the recharging of the vehicle equipped with the female connector element 100 is complete, the operator pulls on the blocking ring by exerting an axial force on the collar 2405, said force being oriented toward the rear of the male connector element 200, as shown by arrows F2 in FIGS. 12 and 13. This makes it possible to withdraw the safety tab 2408 within each locking slot 222 and free the passage for the locking pins 104 toward the respective mouths 2222 of these pins. The operator then rotates the locking ring 216 using the flywheel 218, in the direction opposite that previously mentioned. Since the balls 230 are partially received in the volume V1, they can progress in the grooves 2021 and do not oppose the rotation of the locking ring 216 around the body 202 in the uncoupling direction, i.e., in a rotation direction opposite arrow F1, which makes it possible to progress the locking pins 104 up to the mouths 2222. During the progression of the locking pins 104 in the locking slots 222, the pilot prongs are disconnected from the corresponding contacts, which cuts the power supply for the power circuits. By continuing this movement, the power prongs, then the ground prong are disconnected from their contacts.

At the end of the angular rotation range of the locking ring 216, each ball 230 is across from a cavity 2023 and each locking pin 104 is in an aligned position relative to the mouth 2222 of a locking slot 222, one of the mouths 2222 also being aligned with the mouth 2602, since one of the pins 104 is aligned with the tooth 106. The blocking ring 240, which is released by the operator, is pushed forward again by the spring 260, to the point that it again abuts against the locking ring 216, which results in axially aligning the surface S1 with the balls 230, which are then engaged in the cavities 2023, then kept in place in these cavities. Since the balls 230 kept in the cavities 2023 do not have the option of moving in the circumferential direction, the rotation of the locking ring relative to the body 202 is blocked again. The locking ring is thus immobilized in rotation around the body 202, in a configuration where the mouth 2222 of one of the slots 222 is axially aligned with the mouth 2602 of the indexing slot 206, which guarantees effective alignment of the three locking pins 104 with the mouths 2222 during a subsequent fitting operation of the elements 100 and 200 of the connector R, after the indexing members 106 and 206 are placed in cooperation.

Upon uncoupling, when the blocking ring 240 advances, each release tab 2407 also advances in the corresponding locking slot 222, which results in pushing the locking pin 104 back toward the mouth 2222, thus facilitating the uncoupling of the elements 100 and 200. At the end of this operation, the female body 102 is removed from the male element 200 by the operator, and each pin 104 leaves its locking slot 222 by its mouth 2222. The uncoupling is then effective and the male connector element 200 is ready for another connection, with its locking ring 216 angularly blocked in a configuration compatible with the placement of a new female connector element 100.

Taking into account a situation where the vehicle whose body 500 is equipped with a female connector 100 leaves the recharging station 600 before disconnection by the operator, a safety uncoupling can be provided, by attaching the blocking ring 240 to a stationary point of the recharging station. Thus, a movement of the blocking ring relative to the recharging station is limited to the movement necessary for coupling. In this case, the withdrawal movement of the female connector element 100 borne by the body 500 of the vehicle moving away along the fitting axis XR, while the connector R is still coupled, drives the male body 202 and the locking ring 216 in the same movement of the vehicle, while the blocking ring 240 is retained on the recharging station 600. This results in moving the blocking ring relative to the locking ring toward the rear of the male connector element 200, which retracts the safety tab 2408 and frees the locking pins 104, which are guided by the inclined front edges 2226 toward the mouths 2222 of the locking slots 222 and leave the slots by uncoupling the male and female elements of the connector R and limiting damage.

In light of the preceding, the invention has multiple advantages.

First of all, the obstacles formed by the balls 230 in their first blocking position makes it possible to keep the locking ring 216 in an angular position relative to the body 202 that is compatible with the coupling or fitting of the elements 100 and 200, in particular with the automatic introduction of the locking pins 104 into the locking slots 222, once the male and female bodies 102 and 202 are brought close together and angularly indexed owing to the cooperation of the tooth 106 and the slot 206. The longitudinal bulk of the connector R is reduced relative to that known from EP-A-2,752,946, since the angular position of the locking ring is ensured by the ball(s) 230, whereas it is not necessary to provide a wide entry bevel in the locking slots 222. The movement of the blocking ring 240 is axial, therefore collinear to the coupling force that is transmitted to an axial surface of the blocking ring, namely the end face 2407*a* of the release tab 2407, by the outer peripheral surface of the rollers 1044. This configuration limits the coupling forces.

Furthermore, since the blocking ring 240 has an essentially axial movement and since it is pushed back directly by an axial surface connected to the body of the female connector element 100, the retraction of the release tab 2407 is guaranteed for a given configuration of the locking pins 104 relative to the slots 222. In particular, when the locking pins 104 are in contact with the release tab 2407 to push back the blocking ring 240, the position of these pins can be guaranteed precisely relative to the slots 222 during the release of the rotation of the locking ring 240.

The intermediate withdrawn position of the blocking ring 204 is reached when the pins 104 abut against the rear edges 2228 of the locking slots 222. The rotation of the locking ring 216 in order to lock the pins 104 in the slots 222 is thus released when the pins 104 are fully engaged in a definite manner in the locking slots 222, or in other words, when the entire periphery of each of the rollers 1044 is in a locking slot 222. Thus, the rotation of the locking ring 216 necessarily drives the pins 104 toward their position locked in the closed end 2224 of each locking slot 222. The release of the rotation of the locking ring 216 therefore takes place when this rotation actually allows locking of the pins 104.

The position of the pins 104 is locked against any rotation in the unlocking direction, owing to the longitudinally immobile safety tab 2408. The use of such a safety tab 2408 makes it possible to limit the tangential forces on the balls 230 in the coupled configuration.

Multiplying the balls 230 makes it possible to decrease the periodic contact force between the blocking ring 240 and each of these balls, when the connector R is in the coupled configuration.

Using release tabs 2407 and safety tabs 2408 angularly offset from one another makes it possible to scale down the coupling force to be provided on the locking ring 216.

Furthermore and as shown in FIG. 12, the blocking ring 240 partially covers the locking pins 104 in the coupled configuration of the connector R. This ring thus protects the residual axial space between the locking ring 216 and the blocking ring 240, with respect to dirt and/or pollution.

The separation of the blocking ring 240 into two assembled parts 2402 and 2404 makes it possible to select different materials for these two parts. In the case at hand, a harder material, such as quenched steel, can be used for the rear part 2404 in contact with the balls 230, while a less strong material, such as aluminum, can be used for the front part that is in contact with the locking pins 104.

The unblocking of the rotation of the locking ring is visible by the operator, since the blocking ring 240 is situated on the outside of the body 202 and in this case adopts a withdrawn position relative to the body 202.

The invention is not limited to the embodiment described above, and several alternatives can be considered.

Alternatively, the withdrawn position of the blocking ring 204, in which it frees the obstacles 230, which can then move into their second released position, is reached when only part of each of the pins 104 is engaged in the locking slots 222.

As mentioned above, the number of balls may be different from six. Likewise, the number of locking pins and slots 104 and 222 can be different from three. When several locking pins and slots are used, they are preferably distributed evenly around the axis XR.

Furthermore, the blocking ring 240 can be pushed back toward the rear by a portion of the female body 102 other than the roller 1044 of a locking pin 104, in practice an axial surface of the female body 102 other than that of the locking pins 104. This alternative requires a longer blocking ring to interact directly with the body 102 of the female connector element 100.

Two cavities 2023 in the form of sphere portions can be provided, i.e., one at each end of the angular movement range of the locking ring 216 relative to the pin 104. In the inner radial position, in their first blocking position, the balls 230 cooperate with the first spherical cavity to block the rotation of the locking ring relative to the second body in the uncoupled configuration and, in their second blocking position, with the second spherical cavity to block the rotation of the locking ring relative to the second body in the coupled configuration. The safety tabs 2408 can then be omitted, since the balls are kept in the second spherical cavities in the coupled configuration by the blocking ring in the forward position, which locks the rotation of the locking pins 104 within the locking slots 222.

According to another alternative, each safety tab 2408 can be formed by a release tab. In this case, each safety tab is retracted by the corresponding pin 104 when the latter engages in the mouth 2222 of a slot 222 and this tab protrudes again in the slot 222 when it reaches its locked position, after relative rotation of the pin and the locking slot. Thus, the blocking ring 240 is movable relative to the body 202 between a forward position and a withdrawn position in which the rotation of the locking ring 216 is possible, the blocking ring 240 being in the forward position in the fitted configuration of the connector.

In the example of the figures, the release tab 2407 forms a single piece with the blocking ring 240. This is not mandatory, and the release tab(s) may be made up of one or several rods fastened on the blocking ring.

According to another alternative, the connector may operate automatically upon connection. In other words, when the release tabs 2407 are completely retracted by the pins 104, the pins 104 abut against the inclined rear edges 2228 of the locking slots 222, and any action bringing the body 202 and the body 102 closer together creates a tangential component that rotates the locking ring. In this case, it is not necessary for the operator to exert torque on the flywheel 218.

The indexing tooth 106 can be provided on the body 202, while the indexing slot is provided on the body 102. More than two indexing members 106 and 206 can be provided on the bodies 102 and 202. In an alternative that is not shown, the indexing can be provided by the cooperation of a prong like the prong 112 with a complementary housing arranged on the insulator of the complementary connector element. The distribution of the indexing members relative to the locking pins and slots may differ from the described example. In particular, the pins and slots may not be evenly distributed around the axis XR. The indexing member of a connector element may not be angularly aligned with a locking slot or pin. The angular position of the locking ring, and therefore of each of the mouths of the locking slots, relative to the body of the second connector element, when the rotation of the locking ring is blocked by the obstacles, is chosen, relative to the indexing member of the second connector element, such that it corresponds to the angular position of the locking pins relative to the indexing member of the first connector element. Furthermore, the pins 104 can be single-piece pins.

Lastly, the distribution of the electric prongs and contacts 112, 212 and the like can be different from that which is illustrated. Some contacts may be mounted in the body 102, while the corresponding pins are in the body 202.

The embodiment and alternatives considered above may be combined to generate new embodiments of the invention.

The invention claimed is:

1. An electric connector comprising a first connector element and a second connector element complementary to the first connector element, these two connector elements being provided to fit in one another along a fitting axis, the first connector element comprising a first body that is secured to at least one locking pin and that bears at least one first prong or first contact, at least one first indexing member secured to the first body, the second connector element comprising a second body that supports at least one second contact or second pin complementary to the first prong or first contact, a locking ring mounted around the second body while being axially immobilized, along the fitting axis, and rotatable, around this axis, relative to the second body, this locking ring being provided with at least one locking slot, with a mouth and a locking end provided to receive the locking pin in a configuration where the locking pin is axially locked, along the fitting axis, relative to the second body, and at least one second indexing member secured to the second body and configured to cooperate with the first indexing member to position the first body angularly relative to the second body around the fitting axis, during the fitting of the first and second connector elements, before the engagement of the locking pin in the locking slot, wherein the second connector element comprises:

at least one obstacle movable relative to the locking ring between:

a first blocking position, in which the obstacle blocks the rotation of the locking ring, relative to the second body, and a second, released position in which the obstacle does not oppose a rotation of the locking ring around the second body, a blocking ring movable along the fitting axis relative to the second body between:

a first forward position, and at least one second withdrawn position, and a member for elastically returning the blocking ring toward its first forward position, wherein the obstacle, the locking ring and the second body are configured so that, when the first and second indexing members cooperate and when the obstacle is in its first blocking position, this obstacle blocks the locking ring relative to the second body in a configuration where the mouth of the locking slot is aligned, in a direction parallel to the fitting axis, with the locking pin, and wherein the blocking ring is configured so as, during the fitting of the first and second connector elements and when the first and second indexing members cooperate, to be in its first forward position, in which it keeps the obstacle in its first blocking position, before the locking pin is engaged in the locking slot, and to be pushed by a portion of the first connector element, from its first forward position into its second withdrawn position, in which it does not oppose the passage of the obstacle toward its second released position.

2. The electric connector according to claim 1, wherein the blocking ring is secured in rotation with the locking ring.

3. The electric connector according to claim 1, wherein the second body comprises at least one concave cavity and wherein the obstacle is engaged in the concave cavity when it is in its first blocking position.

4. The electric connector according to claim 3, wherein the body also comprises a circumferential peripheral groove that communicates with the concave cavity and that is able to receive the obstacle when it is in its second released position.

5. The electric connector according to claim 1, wherein the obstacle is movable in a radial orifice of the locking ring and wherein the blocking ring is provided with a first inner radial surface, which, in the uncoupled configuration of the electric connector, surrounds the obstacle and keeps the obstacle in its first blocking position.

6. The electric connector according to claim 5, wherein the blocking ring is provided with a second inner radial surface, which is cylindrical with a circular base and the radius of which is strictly larger than the radius of the first inner radial surface, which is also cylindrical with a circular base, while the second inner radial surface defines a housing for partially receiving the obstacle when the blocking ring is in its second withdrawn position.

7. The electric connector according to claim 6, wherein the blocking ring has multiple parts and comprises a front part intended to be in contact with the portion of the first connector element during the fitting of the first and second connector elements, and a rear part that is provided with first and second inner radial surfaces.

8. The electric connector according to claim 1, wherein the blocking ring comprises a release tab that is aligned with the mouth, in a direction parallel to the fitting axis, which is axially movable in the locking slot and which is configured to be pushed by the portion of the first connector element, which is then formed by the locking pin during the fitting of the first and second connector elements, while moving the blocking ring from its first forward position to its second withdrawn position.

9. The electric connector according to claim 1, wherein during the fitting of the first and second connector elements, the blocking ring reaches its second withdrawn position when the locking pin is completely engaged in the locking slot.

10. The electric connector according to claim 1, wherein it comprises at least three obstacles, preferably six obstacles, distributed around the fitting axis, and each obstacle is formed by a ball.

11. The electric connector according to claim 1, wherein the second connector element comprises:

a safety tab stationary in rotation around the fitting axis, and axially movable along this axis, relative to the locking ring between a first stop position, in which it blocks the passage of the locking pin between the locking end of the locking slot and the mouth of the locking slot, and a second released position, in which it allows the passage of the locking pin, a member for elastically returning the safety tab toward its first stop position.

12. The electric connector according to claim 11, wherein the blocking ring comprises a release tab that is aligned with the mouth, in a direction parallel to the fitting axis, which is axially movable in the locking slot and which is configured to be pushed by the portion of the first connector element, which is then formed by the locking pin during the fitting of the first and second connector elements, while moving the blocking ring from its first forward position to its second withdrawn position, and the safety tab is different from the release tab.

13. The electric connector according to claim 11, wherein the safety tab is fast with the blocking ring.

14. The electric connector according to claim 1, wherein the locking slot comprises a front edge and/or a rear edge inclined relative to the fitting axis and relative to a plane perpendicular to the fitting axis and that extends from the mouth to the locking end.

15. The electric connector according to claim 1, wherein in the fitted configuration of the connector, the blocking ring at least partially covers the locking slot and the locking pin.

* * * * *